US006880814B2

(12) United States Patent
Pluckhahn et al.

(10) Patent No.: US 6,880,814 B2
(45) Date of Patent: Apr. 19, 2005

(54) PROCESS GAS CONDITIONING FOR TOBACCO DRYERS

(75) Inventors: Frank Pluckhahn, Bayreuth (DE); Gerald Schmekel, Elmshorn (DE); Arno Weiss, Norderstedt (DE); Dietmar Franke, Bayreuth (DE)

(73) Assignee: British American Tobacco (Germany GmbH), Hamburg (DE)

( * ) Notice: Subject to any disclaimer, the term of this patent is extended or adjusted under 35 U.S.C. 154(b) by 79 days.

(21) Appl. No.: 10/120,002

(22) Filed: Apr. 10, 2002

(65) Prior Publication Data

US 2002/0185755 A1 Dec. 12, 2002

(30) Foreign Application Priority Data

Apr. 10, 2001 (DE) ..... 101 17 783

(51) Int. Cl.[7] ..... B01F 3/04

(52) U.S. Cl. ..... 261/78.2; 261/116; 261/DIG. 15; 131/303

(58) Field of Search ..... 261/78.2, 116, 261/118, 127, 141, DIG. 15; 131/303; 34/72

(56) References Cited

U.S. PATENT DOCUMENTS

| | | | | |
|---|---|---|---|---|
| 3,906,961 A | * | 9/1975 | Rowell et al. | 131/303 |
| 3,948,277 A | | 4/1976 | Wochnowski et al. | |
| 4,044,780 A | * | 8/1977 | Kelly | 131/303 |
| 4,195,647 A | * | 4/1980 | Wochnowski et al. | 131/296 |
| 4,346,524 A | | 8/1982 | Wochnowski et al. | |
| 4,452,256 A | | 6/1984 | Wochnowski et al. | |
| 4,583,559 A | * | 4/1986 | Hedge | 131/304 |
| 5,095,923 A | * | 3/1992 | Kramer | 131/296 |
| 5,227,018 A | * | 7/1993 | Bro et al. | 159/4.02 |
| 5,995,011 A | | 11/1999 | Clocksin et al. | |
| 6,328,790 B1 | * | 12/2001 | Schwab | 96/323 |
| 6,397,851 B1 | * | 6/2002 | Pluckhahn et al. | 131/296 |

FOREIGN PATENT DOCUMENTS

| | | |
|---|---|---|
| DE | 14 32 575 A | 4/1969 |
| DE | 21 32 226 A | 1/1973 |
| DE | 29 04 308 C2 | 3/1974 |
| DE | 31 14 712 A | 2/1982 |
| DE | 22 40 682 A | 10/1986 |
| GB | 157532 | 5/1964 |

* cited by examiner

*Primary Examiner*—Scott Bushey
(74) *Attorney, Agent, or Firm*—Middleton & Reutlinger

(57) ABSTRACT

The invention relates to process gas conditioning for tobacco dryers. In particular, it relates to a device for conditioning dryer which includes a vaporization unit with a chamber for introducing and vaporizing water to be added to the process gas, wherein the vaporization unit is arranged before the tobacco dryer and before the tobacco is introduced into the process gas. Furthermore, the invention relates to a vaporization unit for introducing water vapor into the flow of process gas in a tobacco dryer which includes a through-flow tank in which water introduced via a number of spray jets is completely vaporized, in contact with the process gas, and to a method for conditioning process gas for a tobacco dryer, in particular a flow dryer, wherein vapor is added to the process gas by introducing and vaporizing water, the water in the flow of process gas being vaporized in an vaporization unit before the tobacco dryer and before the tobacco is introduced into the process gas.

11 Claims, 3 Drawing Sheets

PROCESS GAS CONDITIONING FOR TOBACCO DRYERS

CROSS-REFERENCE TO PRIOR APPLICATIONS

This application claims priority to the German Patent Application No. 101 17 783.6, filed on Apr. 10, 2001, which is incorporated herein by reference.

BACKGROUND OF THE INVENTION

The invention relates to process gas conditioning for tobacco dryers. In particular, the invention relates to a device for conditioning process gas for a tobacco dryer, a vaporization unit for introducing water vapor into the flow of process gas in a tobacco dryer, and to a method for conditioning process gas for a tobacco dryer, in particular a flow dryer.

In the tobacco industry, various methods of drying tobacco are known, for example passing the tobacco through a drum, as is described in DE 22 40 682 C2, or passing the tobacco through a tunnel conveyor, as is described in for example DE 29 04 308 C2. In all cases, it is very important for the tobacco to exhibit a particular moistness at the output of the dryer, which may vary only over a very small range. In order to be able to maintain tobacco moistness at all times, DE 22 40 682 C2 for example propose adding hot water or vapor directly into the moisture drum, while in accordance with DE 29 04 308 C2, water is directly added in the tunnel conveyer. When the water is added directly, there is always the disadvantage that optimum vaporization cannot be achieved, such that clumps are formed. If vapor is introduced separately and directly into a drum, for example into a moisture drum as described in DE 22 40 682 C2, then on the one hand there is an increased expenditure in apparatus, and on the other hand there is no guarantee that the vapor optimally mixes with the actual hot process gas, which could lead to a non-homogenous degree of moisture within the tobacco bulk.

SUMMARY OF THE INVENTION

As opposed to the above method, there is another kind of tobacco drying, wherein cut tobacco is dried by pneumatic transport in a "conduit" using hot, moist gases. Such flow drying is a form of short-time drying, and the present invention concerns such drying systems in particular.

Successful tobacco drying is generally characterized in that the output tobacco end moistness achieved after leaving the dryer must lie within a very narrow range about the so-called index value moistness (for example, 13.5%±0.5%). In order to achieve this target, elaborate control strategies with a high control quality have been developed which, however, are only able to demonstrate their proficiency in connection with suitable control variables/elements.

The degree of tobacco drying depends on the energy content, for example on the temperature of the transporting water vapor-air mixture, since the resting time drying section is determined by the length of the dryer and/or the size of the tobacco separator. The influence of the drying gas temperature is therefore a suitable variable for setting the output tobacco moistness.

In short-time tobacco drying, the process gases are often indirectly heated i.e. the process gas is heated in a heat exchanger. This heating system using the heat exchanger, however, is very slow and cannot react sufficiently quickly to changes in the tobacco input moistness and/or the tobacco input quantity to be able to guarantee a constant tobacco output moistness. This is a problem particularly if for a certain period of time no tobacco can be supplied, since the dryer itself can then overheat. A similar problem occurs if a by-pass control is used to control the process gas temperature and only small mass flows of process gas flow through the heat exchanger. This subjects the heat exchanger itself to high thermal loads, and it may overheat.

Analogous to the method in tunnel or drum dryers, therefore, a certain quantity of water in stable equilibrium (constant tobacco input rate and tobacco input moistness) could be sprayed into the short-time dryer conduit and vaporized therein. If the quantity of tobacco or the tobacco moistness drops, then additional water is simply sprayed in and vaporized (and the process gas is thus quickly cooled by the high enthalpy of vaporization), in order to obtain the desired tobacco output moistness. By contrast, if the quantity of tobacco or the tobacco moistness rises, less water is added, and in this way the tobacco output moistness is likewise kept constant.

Injecting water in this way is disadvantageous if there is no guarantee that the water will evaporate completely, which may lead to contamination (wet inner walls of the apparatus causing wet tobacco particles in the apparatus). In certain circumstances, in the event of deposits, this can even lead to tobacco being baked on to the conduit.

It is an object of the present invention to provide a method of process gas handling for tobacco drying which overcomes the disadvantages of the prior art as described above. In particular, a way is to be shown how the temperature and/or moisture content of the flow of process gas, and therefore also the end moistness of the tobacco to be dried, can be influenced without the cut tobacco forming wet clumps, and wherein importance is attached, amongst other things, to realizing this in a compact design. Furthermore, inertia in adjusting to varying process parameters the time lag between change of material parameters (i.e. tobacco having reduced initial moisture) and change in process parameters (i.e. allow more steam into the system) is preferably to be minimized.

This object is solved in accordance with a first aspect of the invention by a device for conditioning process gas for a tobacco dryer, in particular a flow dryer, comprising a means for introducing and vaporizing water to be added to the process gas, the means comprising a vaporization unit arranged in the flow of process gas, before the tobacco dryer and before the tobacco is introduced into the process gas. In other words, the device in accordance with the invention charges the process gas with moisture at a point in time at which it has not yet come into contact with the tobacco, i.e. the vaporization unit ensures that when the tobacco is introduced, a process gas is already available which exhibits the required process gas moisture and also the process gas temperature. The vaporization unit can in the process gas stream, be arranged downstream of an indirect process gas heating system, in particular a heat exchanger system, overcoming the disadvantage already mentioned above of the inertia of such heat exchanger systems. By setting the water or vapor supply in the vaporizer, changes in the tobacco input moisture and/or tobacco input quantity can be reacted to very quickly.

In another embodiment of the device in accordance with the invention, the vaporization unit comprises a through-flow tank or container in which water introduced via a number of spray jets is completely vaporized, in contact with the process gas. The vaporization unit can be constructed in a compact design and installed in a process gas conduit system, if it is formed such that it comprises a gas inlet, an extended vapor generating chamber connected to the gas inlet, and a gas outlet, the water being introduced into the vapor generating chamber via a number of binary jets arranged in a ring on an extension section or diffuser between the gas inlet and the vapor generating chamber. Preferably, jets are used which introduce water droplets at a speed and droplet size which ensure complete vaporization over a short distance. In this respect, it is possible to set the position of the jets such that the water droplets leaving the jets exhibit substantially the same speed as the flow of process gas, after a short distance. If, for example, the flow of process gas at the gas inlet exhibits a speed of 15 to 45 m/s, then a diffuser angle of 10° to 40°, in particular 25° to 35°, preferably 30° is preferably selected. The process gas speed in the tank should be 2 to 10 m/s, in order to minimize the length of the apparatus. The water spray leaving the jets should exhibit a droplet size <250 $\mu$m, in particular <100 $\mu$m. Preferably, the spray jets or binary jets are arranged such that their spraying areas do not substantially overlap, to prevent larger droplets forming again and to optimally utilize the cross-section of the apparatus, without droplets touching the apparatus wall.

The device for conditioning process gas can be used for tobacco dryers with different cross-sections. The cross-section of the device can be identical to the cross-section of the tobacco dryer or it can differ from it. Possible cross-sections of the device or of the tobacco dryer with which the device is used are rectangular, in particular square, circular, or any shapes in between such as oval, elliptical or in the shape of an elongated hole.

In a preferred embodiment, the device comprises four to twelve, in particular six to ten and preferably eight jets, arranged in a ring, substantially between the middle section and the end section of the diffuser, at the same angular separation from one another, the jets preferably exhibiting a spraying coverage angle of 15° to 30°, in particular 20° to 25° and preferably 22°. The water throughput of the jets can be 150 to 500 kg/h, preferably 200 to 300 kg/h.

The invention further relates to a vaporization unit for introducing water into the flow of process gas in a tobacco dryer, comprising a through-flow tank in which water introduced via a number of spray jets is completely vaporized, in contact with the process gas. The parameters already described above for the device in accordance with the invention can of course also be realized specifically for the vaporization unit in accordance with the invention. This relates in particular to the form of the through-flow tank or vaporization unit and the arrangement and through-flow of the jets. Moreover, it should also be noted that this vaporization unit, or more generally the though-flow tank, and in particular the vapor generating chamber can be constructed in modular longitudinal sections which preferably can be connected to each another via flanges. In this way, the length of the vaporization unit can be adjusted so as to always ensure that the droplets vaporize in the hot process gas before they leave the vaporization unit. This can of course also be achieved by fundamentally adjusting the length of the vaporization unit, though preferably via corresponding intermediate pieces to be installed using flanges, such that it can be adjusted to a possibly desired change of the jets.

In the method in accordance with the invention for conditioning process gas for a tobacco dryer, in particular a flow dryer, vapor is added to the process gas by introducing and vaporizing water, the water being vaporized in the flow of process gas in a vaporization unit before the tobacco dryer and before the tobacco is introduced into the process gas. Here, too, it is possible to realize all of the construction features already mentioned above for the device in accordance with the invention and/or the vaporization unit in accordance with the invention, in accordance with the method.

The subject of the present invention is defined by the enclosed independent patent claims for the device, the vaporization unit and the method, and the sub-claims describe preferred embodiments of the invention. All of the above outlined objectives are to be understood as exemplary only and many more objectives of the invention may be gleaned from the disclosure herein. Therefore, no limiting interpretation of the objectives noted is to be understood without further reading of the entire specification, claims, and drawings included herewith. Various other feature of the present invention will become obvious to one skilled in the art upon reading the disclosure set forth herein.

BRIEF DESCRIPTION OF THE DRAWINGS

The invention will now described on the basis of the enclosed drawings. These show.

DETAILED DESCRIPTION OF THE PREFERRED EMBODIMENTS

Figure 2:
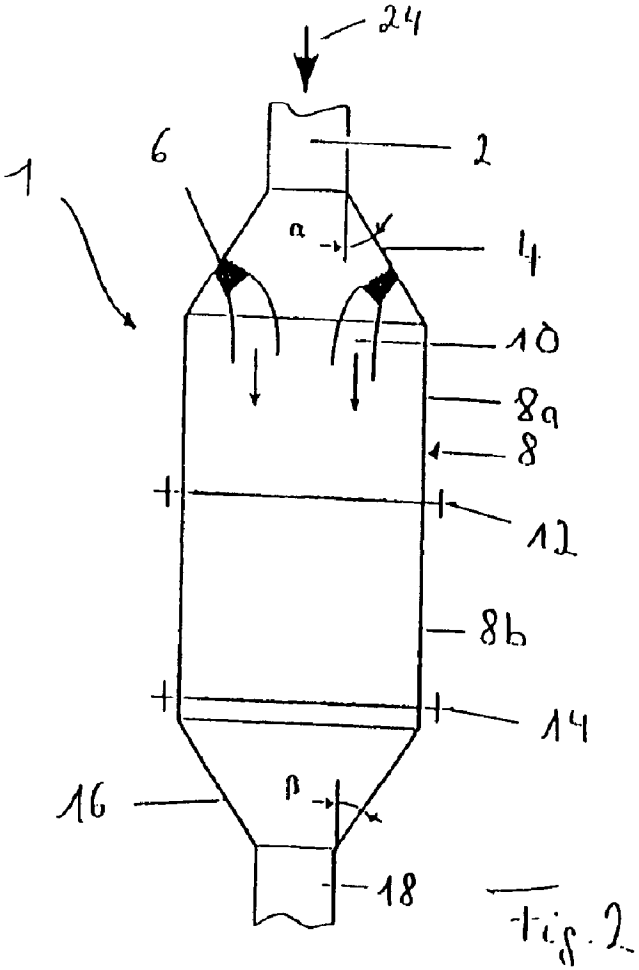
FIGS. 1 and 2 represent a vaporization unit in accordance with the present invention, in a schematic cross-sectional view (FIG. 1) and in a longitudinal sectional view (FIG. 2)
Figure 1:
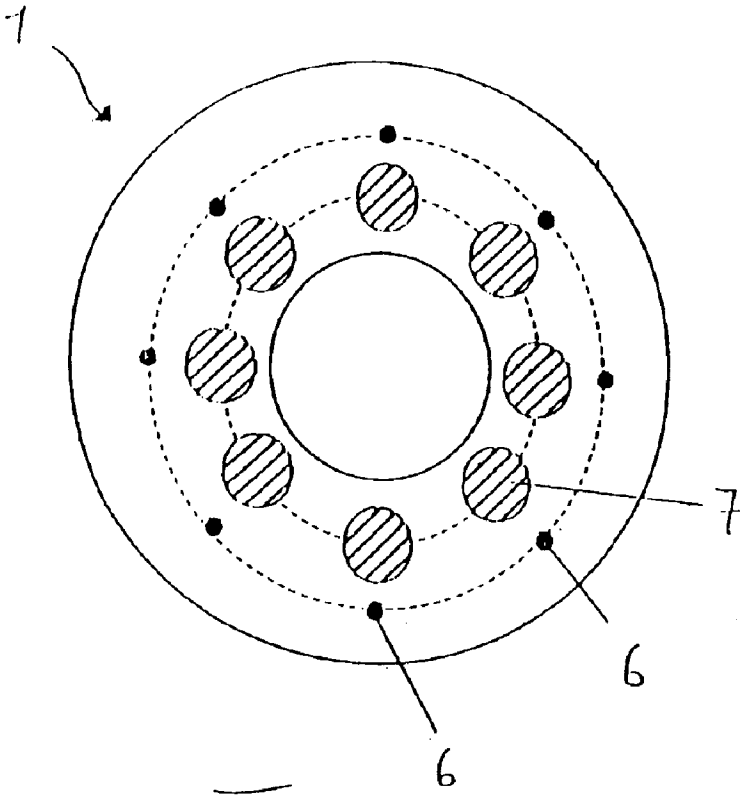

FIGS. 1 and 2 show a vaporization unit in accordance with the invention in a schematic cross-section and in a longitudinal section. Hot process gas, coming for example from a heat exchanger system, flows into the vaporization unit 1 at its gas inlet 2. The process gas is heated in such heat exchanger systems indirectly, by a smoke gas heat exchanger supplied with hot gas from a burner.

A flow of process gas 24 (FIG. 2), once heated in the heat exchanger system, enters the vaporization unit in accordance with the invention at the gas inlet 2. A diffuser 4 is connected to the gas inlet 2, binary jets 6 being arranged in a ring on the circumference of said diffuser 4, with which jets water can be sprayed into the vaporization unit 1. The distribution of the jets 6 can be seen in FIG. 1, wherein eight jets are provided, each with an angular separation of 45°. The spraying projection area of each jet is also indicated in FIG. 1 by the reference numeral 7, and it can be seen here that these projection areas do not overlap in this example.

The vapor generating chamber 8 is connected to the diffuser 4 comprising the jets 6, said chamber being designated as such here because the water injected from the jets 6 is converted to vapor in this area, which then forms a part of the process gas. The chamber 8 is constructed in modules, and FIG. 2 shows the longitudinal sections 8*a* and 8*b* which are integrated via the flanges 12 and 14. Through this modular construction, the chamber 8 can be lengthened or shortened as desired, if this should be required—for example, if other jets are used.

The chamber 8 is followed by the collector 16 or funnel type device which narrows at its lower end, to which the gas outlet 18 is then connected.

In principle, the process gas heated in the heat exchanger system flows through the vaporization unit 1 and is enriched with vaporizing water via the jets 6, such that it emerges at the outlet 18 as a homogenous flow without droplets, into which the cut tobacco can be introduced without there being any danger of clumps forming due to water build-up. By increasing or reducing the water or vapor supply via the jets 6, the process gas temperature can be regulated and thus also the tobacco end moistness adjusted very quickly and directly. Furthermore, a so-called 'dummy load', a load for the dryer, can be adjusted via the water or vapor supply to the process gas, thus also preventing the dryer from overheating, if in the event of interruptions in production resulting in no tobacco input for a period of time.

Some experiments, in accordance with a number of theoretical considerations on vaporizing water droplets sprayed through jets into a system in accordance with the invention, will now be described, which confirm the effectiveness of process gas conditioning in accordance with the invention.

As in all coupled heat and matter exchange processes, the surface area of the droplets produced up until the thermodynamic equilibrium is reached is of critical importance for the vaporization process to proceed quickly. Generating a fine spray is therefore an important basic requirement for successful vaporization. The so-called binary jet is therefore particularly appropriate for solving this object, because this type achieves mists with average diameters below 100 $\mu$m, as opposed to the more basic unitary jet. In principle, binary jets have a restricted throughput of approximately 500 kg/h at the required droplet size of <100 $\mu$m. A number of jets are therefore advantageous, where greater water throughputs are required.

The vaporization time, given simplifying assumptions, is a quadratic function of the droplet diameter. Another variable, which has an influence on the vaporization time required, is the so-called drying gas/droplet relative speed. At small particle diameters, the relative speed becomes negligible after a short particle flow, such that no influence of this value can be observed.

Figure 3:
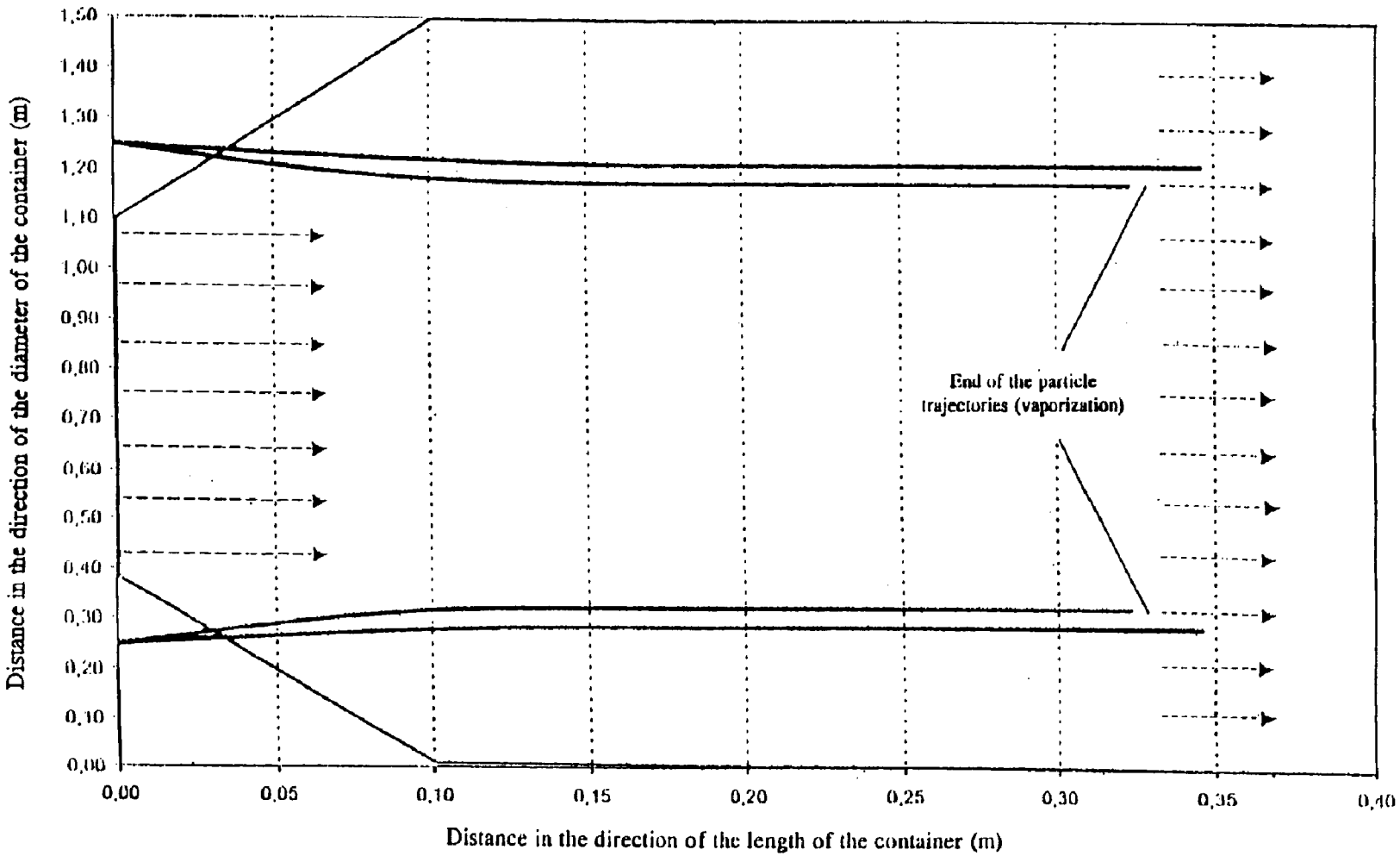
FIGS. 3 and 4 represent diagrams of the droplet flow trajectories in the present invention for droplets of 100 $\mu$m and 50 $\mu$m size, respectively.
Figure 4:
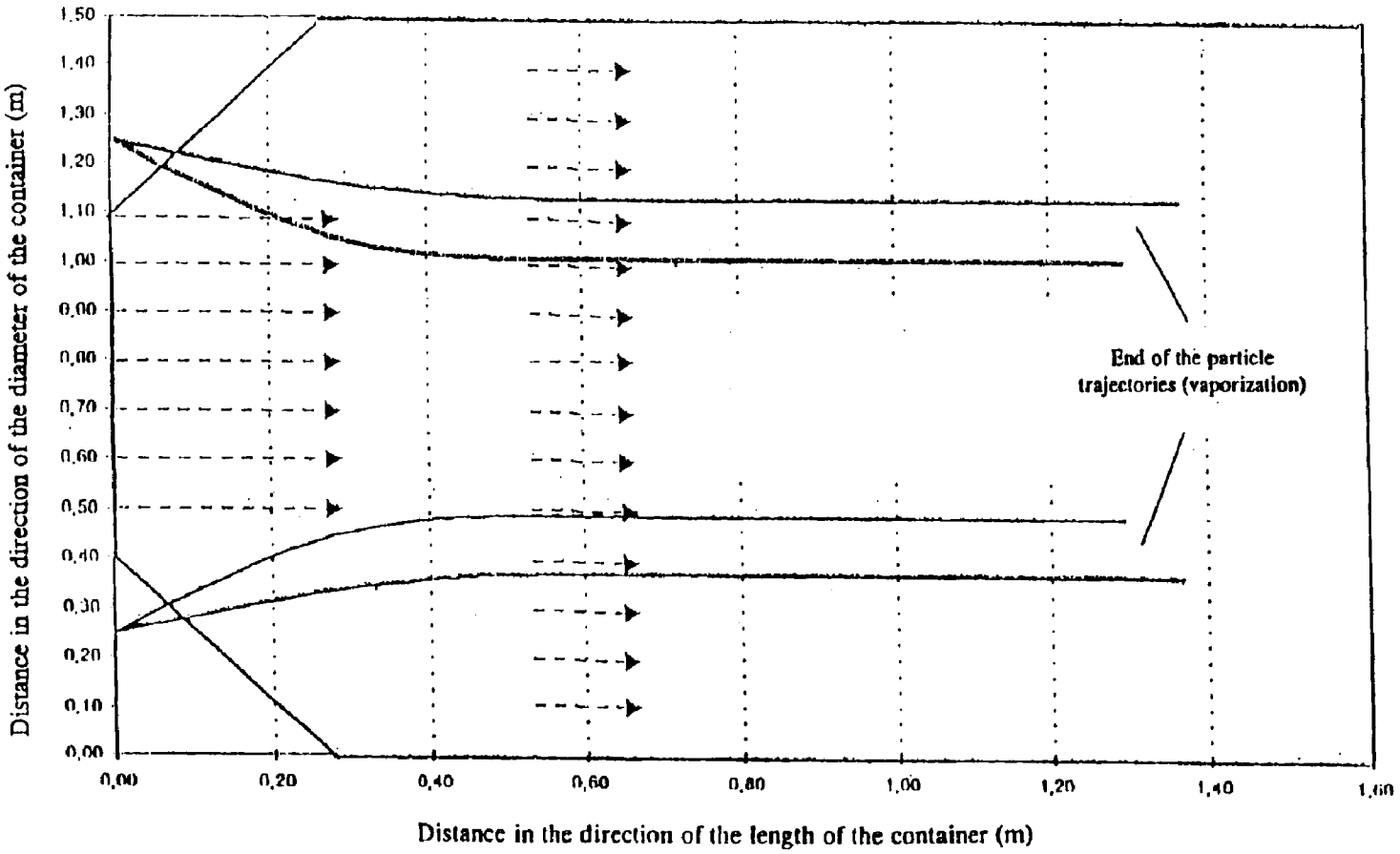

The particle trajectories (flow trajectories) of the droplets are determined by the size, the spraying angle and by the initial speed. In FIGS. 3 and 4, the trajectories for particles at 50 $\mu$m and 100 $\mu$m are approximated. The end of the particle trail represents complete vaporization. It may easily be recognized that smaller particles change completely to a gaseous aggregate state, after just short flow times (container lengths). Furthermore, no corresponding opening in the spraying cone is recognizable, despite a spraying coverage angle of 22°. The flow of drying gas from the spray jets do not keep spreading out after leaving the jets but the droplets are, after a certain path length, again urged toward each other forcing the spray diameter to become smaller. By reducing the spatial distribution of the spraying coverage, however, large spatial concentrations of particles can form which lead to incomplete utilization of the energy content of the flow of drying gas. For this reason, too, it is advantageous to use a number of jets to even out the spatial concentration over the cross-section. If, however, the construction and arrangement are correspondingly adapted, a single jet could also be sufficient, for example a rotating ring gap jet.

As already described above, complete vaporization of the water sprayed in is of great advantage for optimally controlling the tobacco moistness/drying gas temperature in a flow dryer by means of a water jet. Such complete vaporization is carried out in the present invention in a compact apparatus formed in the smallest possible size, in which even large quantities of water to be vaporized are completely vaporized. For reasons of costs and space, the size of the vaporization unit (vaporizer) 1 is an important criterion for its use, not just in the tobacco industry.

Optimum vaporization of the water, as stated, is dependent on many factors. In particular, these are: the size of the water droplets; the temperature of the gas; and, depending on this, the resting time of the droplets in the flow of hot gas. The gas temperature is determined here in the present case of a "flow dryer" in principle, because it is dependent on the tobacco drying process. Given the surrounding condition of the fixed gas temperature, the object is thus to generate droplets which are as small as possible by means of suitable jets and then to give these droplets sufficient time to vaporize.

Small droplets can easily be generated using the available jets (binary jets) 6. If, as in the present case here, up to ~2 tons/hour of water is to be vaporized, this may be done by means of a number of jets 6. One problem with using a number of jets 6 is the agglomeration of "mist curtains" which meet in the working container. In principle (thermodynamically), the droplets should agglomerate as the surface work increases, which would have a detrimental effect on the necessary size (length) of the apparatus. When a number of jets 6 are used, care is taken that the sprays do not meet. For this reason, the quantity of water is distributed amongst a number of smaller jets 6 which then individually generate the necessary spectrum of drops. This is carried out within the framework of the present invention—as shown in FIG. 1.

Assuming that a particular droplet diameter (which should of course be as small as possible) and thus the number of binary jets 6 have been selected, there is a particular vaporization time for these drops. This amount of time must be provided to the drops as a minimum, without their coming into contact with the walls of chamber 8, with any possible diversions (bends in the pipe etc.), with other drops or indeed with the tobacco being added. Otherwise, there would be a fall out or separation of the drops with the danger of water being added in the pipe system. The minimum resting time for the drops in the flow of hot gas, determined by these premises, results in the object of devising a suitable vaporizer 1 (length, diameter etc.) which guarantees that the drops are still situated in the vaporizer 1 within the necessary vaporization time and do not flow through the subsequent pipe system non-vaporized. The most important criterion for the resting time in the vaporizer 1 is the flow speed of the drops. In order to be able to devise the length of the vaporizer 1 as short as possible, the speed of the drops and accordingly the speed of the gas (for very small droplets, approximately the same speed as the gas ⇒ low slippage) must be low. Since the gas speeds are usually between 20 and 40 m/s (here, in the present case, between 20 and 30 m/s) in hot gas pipes, this means that the diameter of the vaporizer 1 has to be increased (diffuser 4) in order to achieve a drop in the gas speed. On the basis of investigations carried out, it has been established that the gas speed should be in the range of about 2 to 10 m/s in order to optimally devise the container with respect to vaporization and length.

Investigations were carried out on a vaporizer such as is shown in FIG. 2, having the following dimensions:

| | |
|---|---|
| Diameter of the gas inlet 2: | 700 mm |
| Diameter of the gas outlet 18: | 700 mm |
| Diameter of the chamber 8: | 1500 mm |
| Length of the chamber: | 800 to 2000 mm |
| Diffuser angle α: | 30° |
| Collector angle β: | 30° |
| Number of jets: | 8 |
| Angular separation of the jets: | 45° |
| Diameter of the arrangement of jets: | 900 mm |

In the experimental construction, the cylindrical length of the chamber 8 could be varied between 0.8 and 2 m, in order to investigate the influence of the resting time of the droplets in the flow of hot gas. The complete vaporization of the drops was assessed by means of a relatively simple construction in terms of apparatus and measuring technique. Thus, an impact sheet package (not shown) was installed in the gas outlet 18 (diameter 700 mm), directly after the chamber 8 in the direction of flow, and the non-vaporized water drops were separated in said impact sheet package by the centrifugal forces arising at the sharp diversions. The impact sheet packages were devised such that the separated water runs toward a collecting bath and is there accumulated. Small temperature sensors (PT 100) were installed at a number of points in said bath. By measuring the temperatures, it is possible to establish whether there is water in the bath. Thus, when the temperature sensors are covered with water, the cooling effect of the water (vaporization cooling) means that the temperature measured approximately corresponds to the so-called cool surface limit temperature of the water/hot air phase mixture. In the cases investigated here (standard pressure and water vapor/air mixture), said temperature is always below 100° C. and accordingly clearly differs from the hot gas temperatures, which in the area of the impact sheet package are between about 120° C. and 200° C. If no water has accumulated in the bath, the temperature measured there corresponds to the hot gas temperature. In the experimental construction, the bath is formed such that it can be simply emptied by means of a pivoting device when an experiment is to be started.

Each individual jet of the eight jets 6 in total has a water throughput of 250 kg/h. The propellant for the jets 6 is saturated vapor; in principle, compressed air may also be used.

The following experiment was carried out:

| Surrounding conditions (see FIGS. 1 and 2) | | | |
|---|---|---|---|
| Chamber diameter: | 1500 mm | chamber length: | 2000 mm |
| Mass flow of gas: | 10,000 kg/h | gas speed in chamber: | 3 m/s |
| Gas moistness: | 80% by mass | jet/container axis: | 300 |

| Mass flow in the jets [kg/h] | Temperature measured before jets activated [° C.] | Temperature calculated after jets activated [° C.] | Temperature measured after chamber 8 [° C.] | Vaporization complete |
|---|---|---|---|---|
| 100 | 400 | 381 | 380 | Yes |
| 200 | 400 | 363 | 365 | Yes |
| 300 | 400 | 345 | 343 | Yes |
| 400 | 400 | 328 | 330 | Yes |
| 500 | 400 | 311 | 312 | Yes |

The jets are uniformly charged with the mass flow. According to the manufacturer's specifications, the spectrum of drops consists of particles of less than 100 μm diameter.

The measured gas temperature and separator sump temperature are in the range of complete vaporization.

The chamber length and the angle at which the jets are positioned can have a significant influence on complete vaporization.

It is to be understood that various changes can be made by one skilled in the art to the preferred embodiments discussed herein without departing from the scope or spirit of the present invention as set forth in the appended claims.

What is claimed is:

1. A device for conditioning process gas for a tobacco dryer comprising a means for introducing and vaporizing water to be added to said process gas, characterized in that said means comprises a vaporization unit (1) which is arranged in the flow of process gas, before the tobacco dryer and before the tobacco is introduced into the process gas and, a diffuser disposed within a process gas inlet to the vaporization unit with a plurality of spray jets arranged in a ring on the circumference of said diffuser.

2. The device as set forth in claim 1, characterized in that the vaporization unit (1) in the flow of process gas is in flow communication with an indirect process gas heating system.

3. The device as set forth in claim 1, characterized in that the vaporization unit comprises a through-flow tank in which water introduced via said spray jets (6) is completely vaporized in contact with the process gas.

4. The device as set forth in claim 1, characterized in that the vaporization unit (1) further comprises an extended vapor generating chamber (8) connected to the gas inlet, and a gas outlet (18), wherein the water introduced into the vapor generating chamber (8) via said plurality of binary jets (6) is arranged in diffuser (4) between the gas inlet (2) and the vapor generating chamber (8).

5. The device as set forth in claim 3, characterized in that said spray jets (6) are used which introduce water droplets at a speed and droplet size which ensure complete vaporization over a short distance.

6. The device as set forth in claim 5, characterized in that the position of the said spray jets (6) is set such that the water droplets leaving the jets exhibit substantially the same speed as the flow of process gas after a short distance.

7. The device as set forth in claim 5, characterized in that when the flow of process gas in the container exhibits a speed of 2 to 10 m/s, a diffuser angle of 10° to 40° is selected.

8. The device as set forth in claim 5, characterized in that the water droplets leaving the jets exhibit a droplet size of less than 250 μm.

9. The device as set forth in claim 3, characterized in that said spray jets are arranged such that their spraying areas do not substantially overlap.

10. The device as set forth in claim 4, characterized in that between four and twelve jets (6) are arranged in a ring, between a middle section and an end section of said diffuser (4), at the same angular separation from one another, wherein said jets (4) exhibit a spraying coverage angle of 15° to 30°.

11. The device as set forth in claim 3, characterized in that said jets (6) exhibit a water throughput of 150 to 500 kg/h.

* * * * *